United States Patent [19]

Kusumi et al.

[11] 4,326,736

[45] Apr. 27, 1982

[54] SWIVEL JOINT FOR REVERSE CIRCULATION DRILL

[75] Inventors: Hiroshi Kusumi, Honjo; Masami Wada, Tsuchiura, both of Japan

[73] Assignee: Hitachi Construction Machinery Co. Ltd., Tokyo, Japan

[21] Appl. No.: 142,165

[22] Filed: Apr. 14, 1980

[30] Foreign Application Priority Data

Apr. 16, 1979 [JP] Japan ..... 54-45339
Apr. 16, 1979 [JP] Japan ..... 54-45341

[51] Int. Cl.[3] ..... F16L 27/00

[52] U.S. Cl. ..... 285/98; 277/24; 285/281

[58] Field of Search ..... 285/281, 165, 98, 278, 285/275; 277/24

[56] References Cited

U.S. PATENT DOCUMENTS 2,501,680 3/1950 King ..... 285/98
2,507,849 5/1950 Bland ..... 285/281
3,460,858 8/1969 Lentzen et al. ..... 285/98
3,497,244 2/1970 Grantom ..... 285/98 X
4,223,923 9/1980 Hill ..... 277/24 X

*Primary Examiner*—Thomas F. Callaghan
*Attorney, Agent, or Firm*—Wenderoth, Lind & Ponack

[57] ABSTRACT

A swivel joint to be located at the upper end of a drill string in reverse circulation drills to support loads occurring on the drill string, the swivel joint including a fixed outer housing, a center housing rotatably mounted in the outer housing through bearings, a hollow inner housing vertically slidably fitted in the center housing, and an upper lid fixedly mounted on the outer housing to close the inner and center housings, the inner housing having at the upper and lower ends thereof flanged projections extending toward the center housing to restrict the range of the vertical sliding movement of the inner housing and being, after imposition and release of a downward thrust, slid upward within a range defined by a spacing between the flanged projection at the lower end of the inner housing and the lower end of the center housing subject to an upward thrust acting thereon, thereby preventing transmission of the upward thrust to the outer housing.

7 Claims, 5 Drawing Figures

SWIVEL JOINT FOR REVERSE CIRCULATION DRILL

BACKGROUND OF THE INVENTION

This invention relates to a swivel joint for reverse circulation drills.

Reverse circulation drills which can cope with various geological conditions are now in wide use, handling from a soft ground having an N value less than 50 to a hard layer such as granite. However, a serious problem arises in boring through hard rock such as granite.

FIG. 1 illustrates a reverse circulation drill in operation for forming a bore through a hard rock layer, in which indicated at 1 is a base installed on the surface for mounting a support frame 2 for the drill string. The drill string support frame 2 includes a kelly mast 2*a*, a hydraulic cylinder 2*b* having a rod end thereof connected to the lower portion of the kelly mast 2*a* through a pin joint, and a lift frame 2*c* supported on the cylinder portion of the hydraulic piston-cylinder through a spherical bearing and adapted to be moved up and down by the inward and outward strokes of the hydraulic cylinder 2*b*.

A swivel joint 3 is fixed at the center of the lift frame 2*c* and has kelly bar 22 connected to the lower end of its inner housing. The kelly bar 22 is in engagement with a rotary table 23 of a drilling torque supply machine which is fixedly mounted on the base 1, thereby driving a drill pipe 24, which is connected to the lower end of the kelly bar 22, a crossover sub 25, a drill collar 26 filled with lead, a stabilizer 27 and a roller bit 28. A bent pipe 19 is provided at the upper end of the swivel joint 3 for connection to a suction pump (not shown) through a suction hose 21.

The reverse circulation drill usually employs a roller bit as shown at 28 in a boring operation through hard rock. The roller bit 28 consists of a conical roller cutter with inserts of super hard tips or a combination of a plural number of conical toothed roller cutters 28*a* of wear resistant material, over which the lead-filled collars 26 are mounted to impose a large drilling load thereon. Therefore, the swivel joint 3 which is located at the top end of the drill string, including the drill pipe and roller bit, is required to support a great load.

Further, in a boring operation through hard rock, the cutters are usually located in asymmetric positions on the bit body in such a manner as to produce an increased crushability by producing an impinging force on the rock. This increases the propelling speeding and improves boring efficiency but subjects the bit body to a localized load, imposing a bending force on the drill pipe which transmits the rotational torque to the bit and as a result flexing the drill pipe to impose a great upward thrust on the swivel joint. Namely, as the roller cutter 28*a* with inserted super hard tips or a combination of toothed edges on the roller is rotated at the bottom of the pit, the bit body is subjected to an eccentric load which tends to produce a bending moment in the drill string thereby flexing the drill pipe 24 which has a lower rigidity as compared with the drill string portion from the crossover sub 25 to the roller bit 28. The bending moment produced in the drill string varies over a wide range depending upon the conditions of the bottom surface of the pit at which the bit 28 is rotated. Therefore, the amount of downward displacement of the top portion of the drill string also varies over a wide range. The above-mentioned upward thrust can be prevented by moving the lift frame 2*c* to follow these variations. However, the follow-up is practically impossible since the variations have time durations shorter than the time period which is necessary for detecting a variation and operating the hydraulic cylinder accordingly.

Therefore, in the boring operation, the lift frame is adjusted by the hydraulic piston cylinder in such a position that the load which is imposed on the bit when the drill string is in a flexed state is maintained at a predetermined value. As the operation proceeds, the flexed drill string is intermittently straightened with the top end of the drill string thrust upward and these flexing and straightening motions are repeated during the operation. Every time the top of the drill string is stretched upward, the swivel joint 3 receives a large upward thrust which acts as an irregular impact. Depending upon the nature of the rock and the length of the drill string, the upward thrust sometimes reaches a load several times greater than the total weight of the drill string, so that the swivel joint and drill string support frame are required to be able to hold the drill string securely against the great loads. It follows that the thrust bearing of the swivel joint and the drill string support frame are required to have large capacity and strength, respectively, to cope with the above-mentioned great loads. In addition, the drill string support frame is required to have means for suppressing the mechanical vibrations which are caused by the impinging upward thrusts.

SUMMARY OF THE INVENTION

It is a primary object of the present invention to provide a swivel joint for reverse circulation drills, which is constructed to keep the outer housing of the swivel joint and the drill string support frame free of the impinging upward forces which are otherwise imposed by the top end of the drill-string which is repeatedly flexed and thrust up during the boring operation.

It is another object of the invention to provide a swivel joint which retains the above-mentioned function without being impeded by earth and sand which are contained in the muddy water passing through the joint.

The above objects are achieved by a swivel joint which comprises: a non-rotatable outer housing; a center housing rotatably mounted in the outer housing through thrust and radial bearings; an inner housing vertically slidably fitted in the center housing and interiorly defining a passage for muddy water; said inner housing having at the upper and lower ends thereof flanged projections extending toward the center housing for limiting the range of sliding movement of the inner housing; said inner and center housing respectively having on the outer and inner peripheries thereof engaging portions which are rotationally lockable with each other within the range of the vertical sliding movement of the inner housing for integrally rotating the inner and center housing; the inner housing, after imposition and release of a downward thrust, being slid upward within the range of a space between the lower end of the center housing and the flanged projection at the lower end of the inner housing subject to an upward thrust acting thereon, thereby preventing transmission of the upward thrust to the center and outer housings.

According to another aspect of the invention, the swivel joint further comprises a dust seal provided between the inner and center housings and a water passage formed around the outer periphery of the inner housing at a position between the dust seal and the flanged projection at the upper end of the inner housing and leading into the inside of the inner housing.

The above and other objects, features and advantages of the invention will become apparent from the following description and appended claims, taken in conjunction with the accompanying drawings which show by way of example a preferred embodiment of the invention.

DESCRIPTION OF PREFERRED EMBODIMENT

The swivel joint of the invention is described more particularly by way of a preferred embodiment which is shown in FIGS. 2 to 5 of the accompanying drawings.

Figure 2:
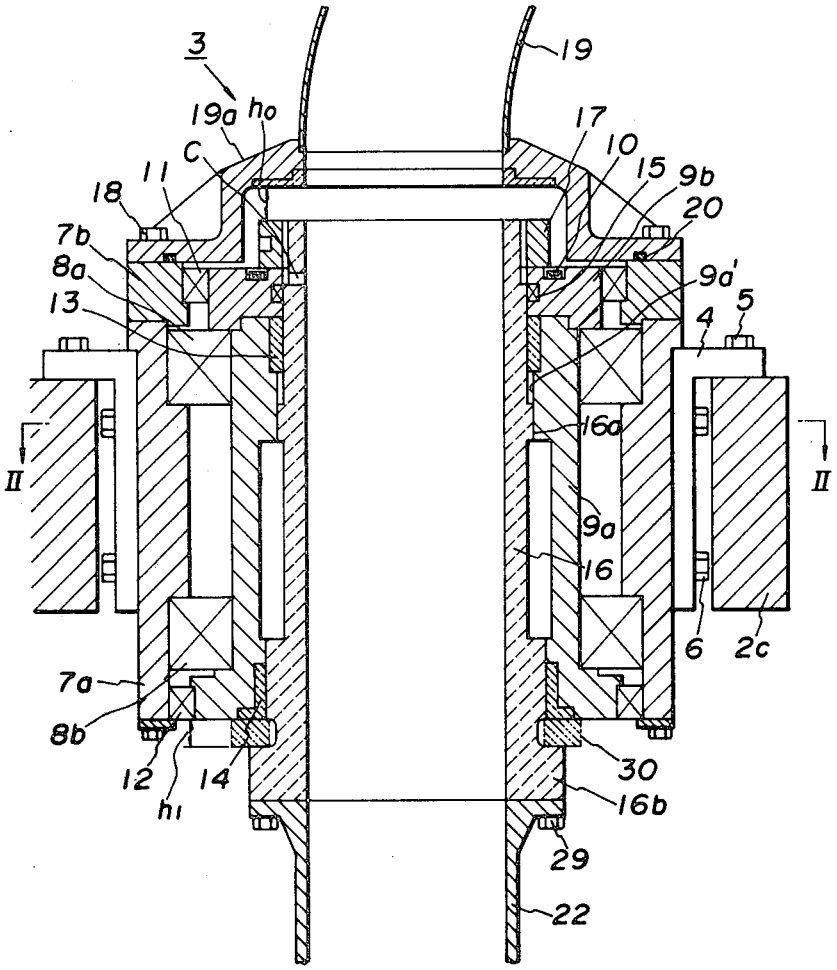
FIG. 2 is an enlarged sectional view as taken on line I—I of FIG. 1, showing a swivel joint embodying the present invention.

Referring first to FIG. 2, a swivel joint 3 is fixed at the center of a lift frame 2*c* of a drill string support frame 2 by bolts 5 and 6 through a suspension 4. The swivel joint 3 of the invention includes an outer housing 7 which is fixed on the lift frame 2*c* through the suspension 4, a center housing 9 which is rotatably received in the outer housing 7 through bearings 8*a* and 8*b*, and an inner housing 16 which is longitudinally slidable relative to the center housing within a limited range but rotatable integrally therewith.

The outer housing 7 consists of a lower outer housing 7*a* and an upper outer housing 7*b* and has its upper open end closed by an upper lid 19*a* which is provided with a bent pipe 19. The upper lid 19*a* and upper and lower outer housings 7*b* and 7*a* are fixed to each other by bolts 18. Indicated at 8*a* and 8*b* are bearings of known types which are provided on the inner side of the outer housing to support thrust and radial loads.

Figure 3:
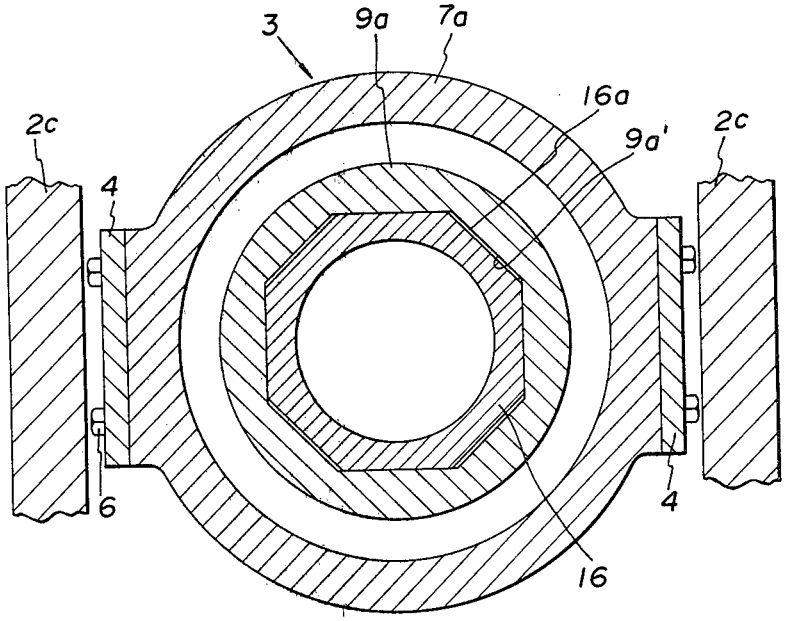
FIG. 3 is a sectional view taken on line II—II of FIG. 2.

The center housing 9 consists of a lower center housing 9*a* and an upper center housing 9*b* which are securely connected with each other by bolts 10. Oil seal 11 and 12 are provided between the upper center housing 9*b* and the upper outer housing 7*b* and between the lower center housing 9*a* and the lower outer housing 7*a*, respectively. On the inner periphery of the lower center housing 9*a*, there is provided an engaging portion 9*a*′ of a polygonal shape in cross-section, as shown in FIG. 3, which is formed over a certain range as will be described hereinafter, with bushings 13 and 14 at the upper and lower ends thereof. In the particular embodiment shown in FIG. 3, the engaging portion 9*a*′ is octagonal in shape which is preferred in consideration of the cross sectional area occupied by the total thickness of the walls of the inner and center housings 16 and 9. In this instance, the distance between the two opposing surfaces of the engaging portion 9*a*′ is greater than the inside diameter of the bushings 13 and 14. Denoted at 15 is a dust seal which is provided on the inner periphery of the upper center housing 9*b* as will be described in greater detail hereinafter.

The inner housing 16 is formed in a cylindrical shape to pass therethrough excavated earth and sand and is provided on its circumference with an octagonal engaging portion 16*a* which is rotationally locked with the engaging portion 9*a*′ of the lower center housing 9*a* as shown in FIG. 3. The inner housing 16 has at its lower end a flanged annular projection 16*b* for suspending a drill string, the flanged annular projection 16*b* having an outside diameter greater than the inside diameter of the bushing 14. The inner housing of the above-described construction is inserted into the center housing 9 from the lower end thereof and is fixed in position by threading a nut 17 on the upper end of the inner housing 16, with the lower end face of the nut 17 in abutting engagment with the top surface of the upper center housing 9*b* to support the inner housing thereon. In this instance, a space $h_0$ is provided between the upper end of the inner housing 16 which is integrally connected with the nut 17 and the inner surface of the upper lid 19*a*, the space $h_0$ being greater in width than a space $h_1$ which is formed between the upper surface of the flanged annular projection 16*b* at the lower end of the inner housing 16 and the lower end face of the lower center housing 9*a*. Indicated at 29 is a bolt for connecting the joint to the kelly bar 22.

Figure 1:
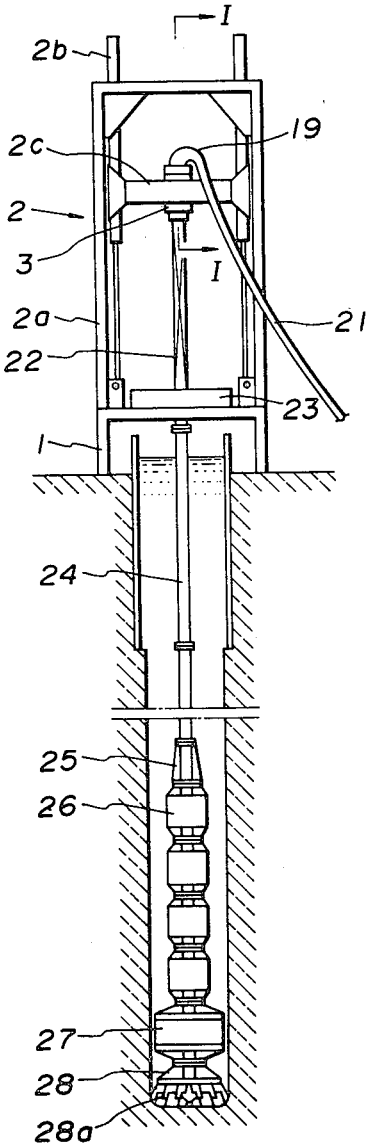
FIG. 1 is a diagrammatic view showing general construction of a reverse circulation drill.
Figure 4:
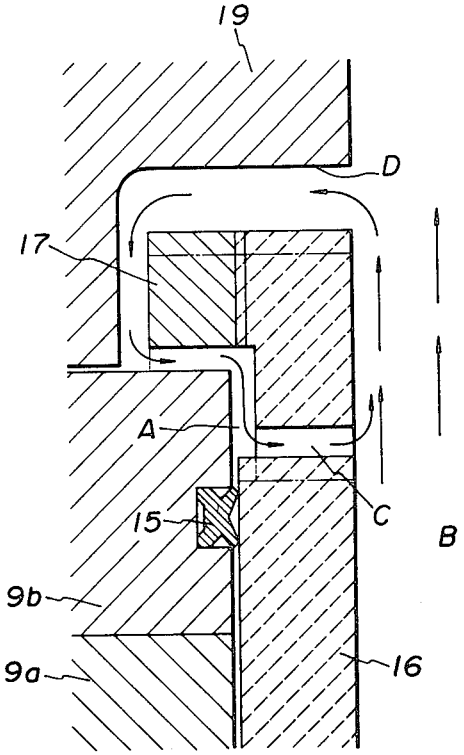
FIG. 4 is a fragmentary sectional view showing a portion of FIG. 2 on an enlarged scale.

The afore-mentioned dust seal 15 is of the type which has lips on opposite sides thereof as shown on an enlarged scale in FIG. 4, and is fitted on the center housing 9. The inner housing 16 is so shaped as to provide an annular groove A around its circumference at a level slightly above the dust seal 15 and with a number of apertures C which intercommunicate the groove A with the inside B of the inner housing 16. The apertures C are located in alignment with the bottom of the groove A, which is so positioned relative to the dust seal 15 such that the upper lip of the dust seal 15 reaches a position proximal to the groove A when the inner housing is raised.

An O-ring 20 is provided between the upper lid 19*a* with the bent pipe 19 and the upper outer housing 7*b* to maintain the joint airtight. Further, seals 11 and 12 are provided between the outer housing 7 and the center housing 9, in addition to the dust seal 15 between the center housing 9 and the inner housing 16, grease being supplied to these seals from a grease nipple (not shown).

In the swivel joint of the invention with the above-described construction, the drilling torque of the rotary table 23 is transmitted to the drill string to rotate the roller bit 28, whereupon the inner housing 16 and center housing 9 are rotated as an integral body by the locking engagement of the engaging portions 9*a*′ and 16*a*. At this time, the thrust and radial loads are supported by the bearings 8*a* and 8*b*.

As the roller cutter 28a rotates at the pit bottom, a bending moment is produced in the drill string as mentioned hereinbefore. As a result, the drill pipe 24 is flexed and the lower surface of the nut 17 at the upper end of the inner housing 16 is abutted against the upper center housing 9*b* to transmit thereto the vertical load, which is further transmitted to the lower outer housing 7*a* through the bearing 8*a* and finally to the lift frame 2*c* through the suspension 4.

In this state, as the drill string is straightened and its upper end is thrust upward, the inner housing 16 which is connected to the kelly bar 22 is also thrust up. However, since the inner housing 16 and center housing 9 are relatively slidable as mentioned hereinbefore and a space of clearance $h_1$ is provided between the flanged annular projection 16b at the lower end of the inner housing and the lower end face of the lower center housing 9a, the upward thrust of the drill string is released without being transmitted to the center housing 9, keeping the bearing 8b of the swivel joint free of the large load resulting from the upward thrust of the drill string. Therefore, it becomes possible to employ known bearings of relatively small capacity for the bearings 8a and 8b and to use a drill string support frame, including a lift frame, which is smaller in weight and thus in production cost as compared with conventional counterparts.

The upward and downward sliding range of the inner housing corresponds to the size of the space $h_1$ which if formed between the lower end face of the lower center housing 9a and the upper surface of the flanged projection 16c of the inner housing when the nut 17 at the upper end of the inner housing is in abutting engagement with the upper surface of the upper center housing 9b. Since the space $h_1$ and the space $h_0$ between the inner housing 16, the upper end faces of the nut 17 and inner housing 16 and the upper lid 19a are in the relation of $h_1 < h_0$, there is no possibility of the upper end of the inner housing 16 hitting against the upper lid 19a when slid upward for splicing the drill pipe after the drilling operation has progressed a certain amount.

In the embodiment shown, the bending moment transmitted to the inner housing 16 from the drill string is converted into a radial load and received by the bushings 13 and 14 which are fitted in the center housing 9. the bushings 13 and 14 and the rotation transmitting portions of the inner and center housings are formed to have an upwardly gradually decreasing inside diameter to facilitate the assembling of the inner and center housings and to guide the sliding movements smoothly.

The sliding inner housing 16 is rotable and spaced by the clearance $h_0$ from the non-rotatable upper lid 19a which has the bent pipe. Therefore, there is a possibility of part of the sedimental components of muddy water being deposited in the clearance and being transferred onto the upper end of the center housing when the inner housing is slid upward by the thrusting load, impeding direct contact of the nut 17 of the inner housing with the center housing 9. In such a case, the distance of sliding displacement of the inner housing is reduced, allowing the thrusting load to be transmitted directly to the thrust bearing.

This problem is precluded in the present invention by the provision of the dust seal which is located between the inner and center housings and of a circulating passage which is formed around the circumference of the inner housing at a position between the dust seal and the bulged upper end (nut 10) of the inner housing and leading into the interior of the inner housing. More particularly, the sedimental components which flow in through the clearance between the inner housing 16 and the upper lid 19a are blocked by the dust seal 15 and scraped by the upper lip of the dust seal 15 toward the groove A during the next sliding movement of the inner housing relative to the dust seal 15. By the pressure of muddy water which flows in through the clearance between the upper end of the inner housing 16 and the upper lid 19a and the suctioning effect of muddy water which flows through the apertures C (into the inner housing 16), the sedimental components are urged into the inner housing 16 as indicated by arrows in FIG. 4. In this manner, the sedimental components of muddy water are prevented from being deposited in the space between the upper end of the center housing 9 and the bulged upper portion (nut) of the inner housing to ensure the sliding movement of the inner housing in response to the upward thrust of the drill string. The apertures C are provided in a horizontal plane for the purpose of preventing reverse flows of the muddy water and encouraging the above-mentioned suctioning effect.

Swivel joints for hard rocks are required to endure severe load conditions and therefore are very costly as compared with the swivel joints for operations on soft ground. However, the deep-boring operations, a swivel joint for hard ground is usually used from the start since it is often the case that a hard layer exists in the deep portion under a soft surface layer, inviting increases of the operational cost due to use of equipment of designs superfluous for soft ground.

Figure 5:
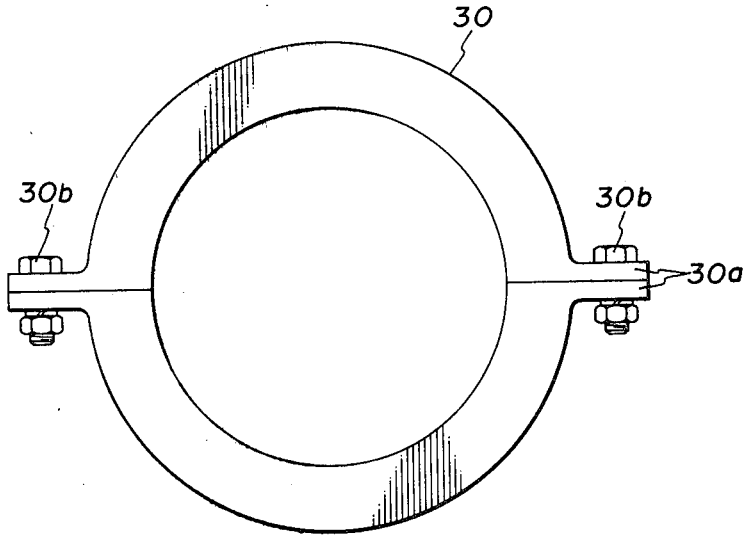
FIG. 5 is a plan view of a fitting member which is used in an operation of soft ground.

In the present invention, it is also possible to use the hard-boring mechanism to keep the swivel joint free of the upward thrusts of the drill string only in boring operations through hard ground, not using the mechanism for a soft-boring operation thereby to prolong its service life. For this purpose, in another aspect of the present invention, there is employed a fitting member 30 of a thickness substantially equivalent to the size of the clearance $h_1$ between the upper surface of the flanged annular projection 16b at the lower end of the inner housing 16 and the lower end face of the lower center housing 9a. In other words, the fitting member 30 is in the form of a ring having a thickness which occupies substantially the entire clearance $h_1$ and which is preferably split into two or a plural number of segments with flanged ends 30a as shown in FIG. 5, the flanged ends 30a of adjacent segments being abutted and secured to each other by bolts 30b. This fitting member 30 is removed during a hard-boring operation, and, prior to a soft-boring operation, fitted in position between the upper surface of the flanged projection 16b at the lower end of the inner housing and the lower end face of the lower center housing 9a as shown in phantom in FIG. 2.

In the soft-boring operation with the fitting member 30, the upwardly thrusting load of the drill string is transmitted to the bearing 8b through the inner and center housings 16 and 9. Namely, the sliding movement of the inner housing 16 is blocked by the fitting member 30 since there is only a slight upward thrust during the soft-boring operations or, even if it should occur, is of a far smaller magnitude than the ones which are experienced in hard-boring operations, a magnitude which can be sufficiently supported by an ordinary bearing 8b.

Thus, the fitting member 30 is removed during the hard-boring operation to increase the boring speed and efficiency while keeping the swivel joint free of the loads of upward thrusts of the drill string, and fitted in position during the soft-boring operation to hold at rest the damping mechanism for the hard-boring operation, thereby prolonging the service life of the seals and other component parts of the damping mechanism.

What is claimed is:

1. A swivel joint for a reverse circulation drill, comprising:

a non-rotatable outer housing;

a center housing rotatably mounted in said outer housing through thrust and radial bearings;

an inner housing vertically slidably fitted in said center housing and interiorly defining a passage for muddy water; and an upper lid having a bent pipe for conducting muddy water from said inner housing to a suction hose;

said inner housing having at the upper and lower ends thereof flanged projections extending toward said center housing for limiting the sliding movement of said inner housing;

said inner and center housings having respectively on the outer and inner peripheries thereof engaging portions which are rotationally lockable with each other within the range of the vertical sliding movement of said inner housing for integrally rotating said inner and center housings:

said inner housing, after imposition and release of a downward thrust, being slid upward within the range of a space between the lower end of said center housing and the flanged projection at the lower end of said inner housing subject to an upward thrust acting thereon, thereby preventing transmission of said upward thrust to said center and outer housings.

2. A swivel joint as defined in claim 1, wherein a space $h_0$ which is formed between said flanged projection at the upper end of said inner housing and said upper lid when said flanged projection at the upper end of said inner housing is in abutting engagement with said center housing is greater than a space $h_1$ between said flanged projection at the lower end of said inner housing and the lower end of said center housing.

3. A swivel joint as defined in claim 1, wherein said flanged projection at the upper end of said inner housing is formed by a nut, said flanged projection at the lower end of said inner housing has integrally formed therewith a flange for connection to a drill string, and said inner housing is fitted in said center housing in bushings located on the upper and lower sides of said engaging portions, said bushings and engaging portions having an upwardly gradually decreasing inside diameter.

4. A swivel joint as defined in claim 1, wherein said engaging portion on the outer and inner peripheries of said inner and center housings are octagonal in shape in section.

5. A swivel joint for a reverse circulation drill, comprising:

a non-rotatable outer housing;

a center housing rotatably mounted in said outer housing through thrust and radial bearings;

an inner housing vertically slidably fitted in said center housing and interiorly defining a passage for muddy water;

an upper lid having a bent pipe for conducting muddy water from said inner housing to a suction hose;

said inner housing having at the upper and lower ends thereof flanged projections extending toward said center housing for limiting the sliding movement of said inner housing;

said inner and center housings respectively having on the outer and inner peripheries thereof engaging portions which are rotationally lockable with each other within the range of the vertical sliding movement of said inner housing for integrally rotating said inner and center housings;

a dust seal provided between said inner and center housings; and a water passage formed around the outer periphery of said inner housing at a position above said dust seal and leading into the inside of said inner housing.

6. A swivel joint as defined in claim 5, wherein said water passage includes a number of apertures leading into the inside of said inner housing from the outer periphery thereof.

7. A swivel joint as defined in claim 5, wherein said dust seal is fitted on said center housing and provided with a lip at least on the upper side thereof for scraping sedimental components of muddy water.

* * * * *